US007751746B2

(12) United States Patent
Miyawaki et al.

(10) Patent No.: US 7,751,746 B2
(45) Date of Patent: Jul. 6, 2010

(54) DEVICE FOR DRIVING ROTARY BODY WITH MECHANISM FOR DAMPENING FLUCTUATION IN ROTATION VELOCITY

(75) Inventors: Katsuaki Miyawaki, Kanagawa (JP); Tetsuo Watanabe, Kanagawa (JP); Takeo Tsukamoto, Kanagawa (JP); Katsuhiro Aoki, Kanagawa (JP); Kei Yasutomi, Kanagawa (JP); Hitoshi Maruyama, Tokyo (JP); Hiroshi Ikeguchi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/081,305

(22) Filed: Apr. 14, 2008

(65) Prior Publication Data

US 2008/0261768 A1 Oct. 23, 2008

(30) Foreign Application Priority Data

Apr. 17, 2007 (JP) ..... 2007-108590

(51) Int. Cl.
*G03G 15/00* (2006.01)

(52) U.S. Cl. ..... 399/107; 399/167; 310/83; 475/343; 475/183

(58) Field of Classification Search ..... 399/167; 475/343, 183
See application file for complete search history.

(56) References Cited

U.S. PATENT DOCUMENTS 6,023,596 A * 2/2000 Makino ..... 399/167
6,420,807 B1 * 7/2002 Tsujimoto et al. ..... 310/83

FOREIGN PATENT DOCUMENTS

| | | |
|---|---|---|
| JP | 01-282567 | 11/1989 |
| JP | 10-288915 | 10/1998 |
| JP | 3013779 | 12/1999 |
| JP | 2000-228846 | 8/2000 |
| JP | 2005-080399 | 3/2005 |
| JP | 2006-333409 | 12/2006 |

OTHER PUBLICATIONS

English Language Abstract of JP 09-171327 dated Jun. 30, 1997.

* cited by examiner

*Primary Examiner*—David M Gray
*Assistant Examiner*—Roy Yi
(74) *Attorney, Agent, or Firm*—Harness, Dickey & Pierce, P.L.C.

(57) ABSTRACT

A rotary-body driving-force transmitting mechanism transmits a driving force from a driving-force source to a rotary body. A rotary-inertial-body driving-force transmitting mechanism transmits the driving force to a rotary inertial body that suppresses a velocity fluctuation in the rotary body. A rotational velocity shift mechanism shifts the rotational velocity. The rotary inertial body, the rotary-body driving-force transmitting mechanism, and the rotary-inertial-body driving-force transmitting mechanism are provided coaxially with a rotary shaft of the rotary body. A satellite frictional gear mechanism is used as the rotational velocity shift mechanism.

19 Claims, 11 Drawing Sheets

Related Art

Related Art

DEVICE FOR DRIVING ROTARY BODY WITH MECHANISM FOR DAMPENING FLUCTUATION IN ROTATION VELOCITY

CROSS-REFERENCE TO RELATED APPLICATIONS

The present application claims priority to and incorporates by reference the entire contents of Japanese priority document 2007-108590 filed in Japan on Apr. 17, 2007.

BACKGROUND OF THE INVENTION

1. Field of the Invention

The present invention relates to a driving device equipped with a rotary inertial body, and an image forming apparatus.

2. Description of the Related Art

Rotary body driving devices that are equipped with a rotary body and a rotary inertial body (flywheel) to maintain a constant rotational velocity of the rotary body are well known. Such rotary body driving devices are widely used as photosensitive drum driving devices in image forming apparatuses such as copiers, facsimile machines, and printers. In an image forming apparatus, image data is written on the photosensitive drum functioning as a rotary body by an optical scanning unit to form a toner image on the photosensitive drum, the toner image is transferred to a recording medium, and the toner image on the recording medium is fixed o obtain the image. It is important to maintain a constant rotational velocity of the photosensitive drum when the image data is being written to the photosensitive drum by the optical scanning unit or when the toner image is being transferred to the recording medium. Any variation in the velocity of the photosensitive drum will cause deterioration in the quality of the toner image or of the image being transferred to the recording medium.

To maintain a constant rotational velocity of the photosensitive drum, it would be advantageous to increase the inertial energy E of the rotary inertial body, which is represented by the equation $E=(J\omega^2)/2$ (where J is the inertial moment of the rotary inertial body and $\omega$ is the angular velocity of the rotary inertial body). In other words, either the inertial moment J or the angular velocity $\omega$ of the rotary inertial body can be increased.

The inertial moment J can be increased by using a heavy and large-diameter rotary inertial body. However, such a rotary inertial body will occupy more space owing to its size, and owing to its weight, necessitates increasing the rigidity of a supporting mechanism for the rotary inertial body, pushing up the cost. The size will also hinder accessing the parts beyond to the rotary inertial body for maintenance purpose.

Driving devices in which angular velocity of the rotary inertial body is increased so as to be greater than the angular velocity of the photosensitive drum are disclosed in Japanese Patent Application Laid-open No. 3013779 and Japanese Patent Application Laid-open No. H10-288915.

FIG. 10 is a drawing of the driving device disclosed in Japanese Patent Application Laid-open No. 3013779.

A driving motor (driving-force source) 105 that drives a photosensitive drum 1 is fixed to a frame 102 of an image forming apparatus. A first small gear 106 is fixed to a first rotary shaft 110 of the driving motor 105, and engages with a first large gear 107. The first large gear 107 along with a second small gear 108 is fixed to the first rotary shaft 110, which is rotatably supported by the frames 102 and 103. The second small gear 108, which engages with a second large gear 109, is fixed to a second rotary shaft 111 (input shaft), which is rotatably supported by the frames 102 and 103. A first shaft joint 112 is fixed to the end of the second rotary shaft 111.

A second shaft joint 113 is fixed to the end of a third rotary shaft 1*a*, which serves as the rotational center for the photosensitive drum 1. The second shaft joint 113 is fixed to the first shaft joint 112. A first pulley 118 is fixed to the second rotary shaft 111.

A wheel rotary shaft 119 (output shaft) is supported by the frames 102 and 103 of the image forming apparatus. A flywheel 120, which serves as the rotary inertial body and stabilizes the rotational velocity of the photosensitive drum 1, is fixed to the wheel rotary shaft 119. A second pulley 121 is fixed to the wheel rotary shaft 119. The diameter of the second pulley 121 is smaller than that of the first pulley 118. An endless belt 122 is wound around the second pulley 121 and the first pulley 118.

The driving force of the driving motor 105 is transmitted to the second rotary shaft 111 (input shaft) via the gears 106 to 109, which reduce the rotational velocity before it is transmitted to the second rotary shaft 111. As a result, the first pulley 118 fixed to the second rotary shaft 111 (input shaft) rotates, simultaneously rotating the third rotary shaft 1*a* via the shaft joints 112 and 113, and therefore, the photosensitive drum 1. The driving force of the first pulley 118 is transmitted to the second pulley 121 by the endless belt 122, causing the second pulley 121 as well as the flywheel 120, which is coaxial with the second pulley 121, to rotate. As the radius of the first pulley 118 is larger than that of the second pulley 121, the angular velocity of the flywheel 120 is greater than that of the photosensitive drum.

Thus, by increasing the angular velocity $\omega$ of the flywheel 120, which serves as the rotary inertial body, the inertial energy E can be increased without having to increase the inertial moment J. Thus, required inertial energy can be obtained even with a light and small-diameter flywheel 120. As a result, the flywheel 120 can be fitted in a smaller space. Further, the rigidity of the shaft bearing and the frames 102 and 103 that support the wheel rotary shaft 119 need not be increased, thus preventing cost escalation.

FIG. 11 is a drawing of a driving device disclosed in Japanese Patent Application Laid-open No. H10-288915.

The driving device disclosed in the patent document includes a velocity-varying mechanism 130 to increase the angular velocity of the flywheel 120 rather than that of the photosensitive drum 1. The velocity varying mechanism 130 includes a large friction wheel 128 fixed to the second rotary shaft 111 (input shaft) and a small friction wheel 129 fixed to the wheel rotary shaft 119 (output shaft) and engaging with and rotating with the large friction wheel 128.

The driving device disclosed in this patent document also realizes increased angular velocity $\omega$ to obtain increased inertial energy E while keeping the radius and weight of the flywheel 120 low.

However, in the velocity-varying mechanism disclosed in the former patent document a large tensile force is imposed on the endless belt 122 so as to prevent the first pulley 118 and the second pulley 121 from slipping. The tensile force causes the second rotary shaft 111 (input shaft) and the wheel rotary shaft 119 (output shaft) to bend towards each other, resulting in wobbling of the flywheel 122 and the photosensitive drum 1. The vibrations generated by the wobbling increases the velocity variation in spite of the flywheel 122. In the velocity-varying mechanism 130 disclosed in the latter patent document, significant pressure is required so that the small friction wheel 129 does not slip off the large friction wheel 128. As a result, the second rotary shaft 111 (input shaft) and the wheel rotary shaft 119 (output shaft bend away from each other, causing the flywheel 120 and the photosensitive drum 1 to wobble.

To avoid slipping, gears, etc., which have better gripping power because of presence of teeth, can be used in the velocity-varying mechanism. However, here again vibrations occur due to backlash or precision of teeth meshing profile.

Further, in the velocity-varying mechanisms disclosed in the two patent documents, the wheel rotary shaft 119 has to be located off a position coaxial with the second rotary shaft 111, increasing the size of the driving device in the radial direction of the rotary shaft.

SUMMARY OF THE INVENTION

It is an object of the present invention to at least partially solve the problems in the conventional technology.

According to an aspect of the present invention, there is provided a driving device including a driving-force source; a rotary-body driving-force transmitting mechanism that transmits a driving force of the driving-force source to a rotary body; a rotary inertial body that suppresses a velocity fluctuation in the rotary body; a rotary-inertial-body driving-force transmitting mechanism that transmits the driving force of the driving-force source to the rotary inertial body; and a rotational velocity shift mechanism that shifts the rotational velocity provided in at least either of the rotary-body driving-force transmitting mechanism and the rotary-inertial-body driving-force transmitting mechanism. The rotary inertial body, the rotary-body driving-force transmitting mechanism, and the rotary-inertial-body driving-force transmitting mechanism are set coaxially with a rotary shaft of the rotary body. A satellite frictional gear mechanism is used as the rotational velocity shift mechanism.

Furthermore, according to another aspect of the present invention, there is provided an image forming apparatus including a rotary body and a driving device for driving the rotary body. The driving device includes a driving-force source, a rotary-body driving-force transmitting mechanism that transmits a driving force of the driving-force source to the rotary body, a rotary inertial body that suppresses a velocity fluctuation in the rotary body, a rotary-inertial-body driving-force transmitting mechanism that transmits the driving force of the driving-force source to the rotary inertial body, and a rotational velocity shift mechanism that shifts the rotational velocity provided in at least either of the rotary-body driving-force transmitting mechanism and the rotary-inertial-body driving-force transmitting mechanism. The rotary inertial body, the rotary-body driving-force transmitting mechanism, and the rotary-inertial-body driving-force transmitting mechanism are set coaxially with a rotary shaft of the rotary body. A satellite frictional gear mechanism is used as the rotational velocity shift mechanism.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
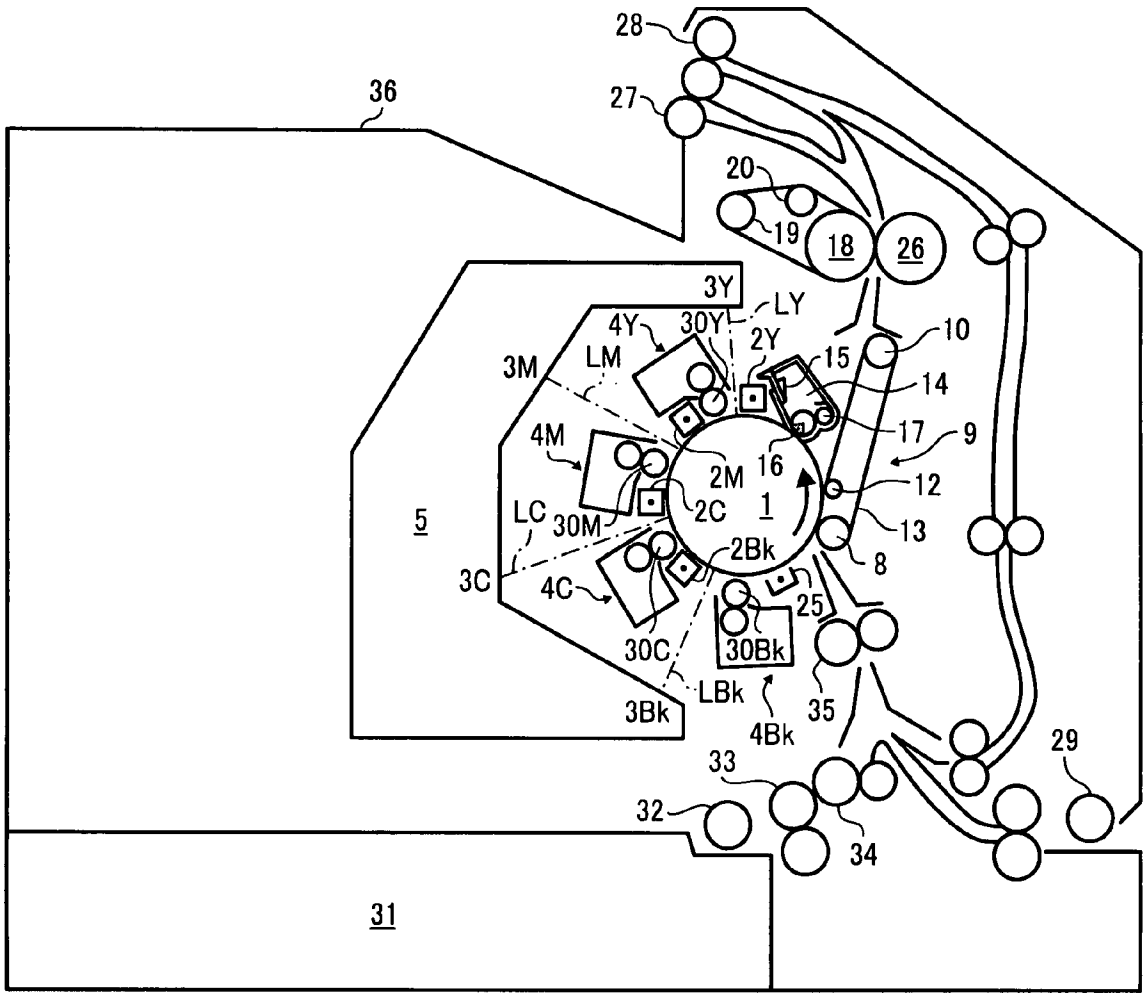
FIG. 1 is a schematic diagram of a printer according to an embodiment of the present invention.

FIG. 1 is a schematic diagram of an image forming apparatus (a printer) according to an embodiment of the present invention. An image forming unit that takes the central portion of the image forming apparatus includes a photosensitive drum 1 that functions as an image carrying member. One each of a charging device 2 and a developing device for each of the colors yellow (Y), magenta (M), cyan (C), and black (Bk) for forming toner images of the respective colors are arranged around the photosensitive drum 1 in a counter-clockwise direction from the top. To the left of the image forming apparatus is disposed a laser device 5 that illuminates the photosensitive drum 1 with a laser beam L, and illuminates with the laser beam L an exposing unit disposed between each pair of charging device 2 and developing device 4 required for forming a latent image of each color. In other words, around the photosensitive drum 1 are arranged four sets of charging device 2, exposing unit 3, and developing device 4 corresponding to each of the colors yellow (Y), magenta (M), cyan (C), and black (Bk). That is, for yellow the charging device 2Y, the exposing unit 3Y, the developing device 4Y, for magenta the charging device 2M, the exposing unit 3M, and the developing device 4M, for cyan the charging device 2C, the exposing unit 3C, and the developing device 4C, and for black the charging device 2Bk, the exposing unit 3Bk, and the developing device 4Bk are sequentially arranged around the photosensitive drum. Downstream to the developing device 4Bk, a transfer belt device 9 and a cleaning device 14 are disposed around the photosensitive drum 1. The image forming unit according to the embodiment is in the form a process cartridge that includes the photosensitive drum 1, the charging device 2, the developing device 4, and the cleaning device 14 as an integral unit and that can be removed from or inserted into the main unit of the image forming apparatus. The structure of a process cartridge need not be confined to what is described in the embodiment. The image forming unit need not necessarily be integrated as a process cartridge.

In the following description, a component member of the process cartridge is referred to by its reference numeral without a suffix of Y, C, M or Bk in a description where the distinction of toner colors is not necessary.

The charging device 2 is a scorotron charger that, when voltage is supplied by a not shown power source device provided in the main unit, performs charging through corona discharging between a grid held at a predetermined voltage against an organic photoconductive layer of the photosensitive drum 1 and a discharge wire, and thereby applies uniform voltage on the surface of the photosensitive drum 1.

The laser device 5 is an integrated unit that exposes the photosensitive drum 1 at four places with the laser beam L emitted in a radiating manner. The laser device 5 throws the laser beam L on the exposing unit 3 on the uniformed charged photosensitive drum 1 according to the image data of each color to form a latent image of each color. The laser device 5 can be four different entities corresponding to the four colors or can be a light-emitting diode (LED) array.

The developing device 4 is disposed facing the photosensitive drum 1, and includes a developing roller that electrostatically transports the toner and conveys it to the developing area of the photosensitive drum 1.

The transfer belt device 9 includes a transfer belt 13, and a driving roller 10, a driven roller 8, and a transfer roller 12 over which the transfer belt is tightly stretched. The transfer roller 12 is located on the inner side of the transfer belt 13 at the place where the transfer belt 13 comes in contact with the surface of the photosensitive drum 1 and marks a transfer area where the toner image is transferred from the photosensitive drum 1 to a recording sheet carried by the transfer belt 13. The transfer belt 13 is an endless belt and is made of two rubber layers. The base layer is a 0.5 to 2.0 mm thick semiconductive layer of silicone rubber or urethane rubber and having a volume resistance of $10^8$ to $10^{12}$ ohm-cm. The top layer is a 5 to 50 μm thick fluorine-coated semiconductive layer that prevents toner filming. The base layer can be a 0.1 to 0.5 mm thick semiconductive layer made of polyester or polystyrene, polyethylene, polyethylene terephthalate, etc. A not shown belt cleaning device that cleans the surface of the transfer belt 13 is provided near the transfer belt 13.

The cleaning device 14 includes a cleaning blade 15 and a fur brush 16. The cleaning device 14 can be just the cleaning blade 15 alone.

A fixing device 18 is disposed downstream to the transfer belt device 9 in the recording sheet conveying direction. The fixing device 18 includes a pair of rollers that support a fixing belt 19, a tension roller 20, and a pressure roller that presses against the fixing roller.

In the lower part of the main unit of the image forming apparatus are disposed a paper feeding cassette 31, a paper feeding roller 32, and a feed roller 33. The paper feeding cassette 31 houses the recording sheets which serve as transfer material. The paper feeding roller 32 and the feed roller 33 forward the recording sheet from the paper feeding cassette. A pair each of conveying rollers 34 and registration rollers 35 are disposed in the sheet conveyance path leading up to the transfer belt 13. An ejection roller 27 that ejects the recording sheet to a recording sheet stacking unit is disposed in the sheet conveyance path after the fixing device. A reversing roller 28 is disposed a path used for the duplex printing. Further, three sets of conveying rollers are disposed in the sheet conveyance path leading up to the pair of registration rollers 35. A manual paper feeding unit, a pick up roller 29 and a feed roller are disposed to the left of the main unit.

The functioning of the image forming apparatus having a structure described above is described next.

An image read by an imaging element of a not shown image reading device, which is a separate device from the image forming apparatus or an image edited by a computer is once stored in the memory as image signals of each of the colors Y, M, C, and Bk. A not shown photosensitive-drum driving motor actuates the photosensitive drum 1 and as a result the photosensitive drum 1 rotates in the counter-clockwise direction. The charging device 2Y for yellow applies a potential on the photosensitive drum 1. The charged photosensitive drum 1 is illuminated by a laser beam $L_Y$ by the laser device 5. The exposure of the photosensitive drum 1 by the laser beam $L_Y$ forms a yellow latent image on the photosensitive layer of the photosensitive drum 1 it turns. The developing roller 30Y of the developing device 4Y for yellow develops the yellow latent image by a non-contact developing method using the toner carried to the part facing the photosensitive drum 1, thus forming a yellow (Y) toner image on the photosensitive drum 1.

The charging device 2M for magenta applies a potential on the yellow toner image on the photosensitive drum 1. The charged photosensitive drum 1 is illuminated by a laser beam $L_M$ y the laser device 5. The exposure of the photosensitive drum 1 by the laser beam $L_M$ forms a magenta latent image on the photosensitive layer of the photosensitive drum 1 as it turns. The developing roller 30M of the developing device 4M for magenta develops the magenta latent image by a non-contact developing method using the toner carried to the part facing the photosensitive drum 1, thus forming a magenta (M) toner image on the photosensitive drum 1. Similarly, by the charging devices 2C and 2Bk and exposure by the laser beams $L_C$ and $L_{Bk}$, and the process by the developing devices 4C and 4Bk, a cyan (C) toner image and a black (Bk) toner image, respectively, are formed on the photosensitive drum.

The recording sheet is picked up from the paper feeding cassette 31 by the paper feeding roller 32, the feed roller 33, and the pair of conveying rollers 34, conveyed to the pair of registration rollers 35, and therefrom to the transfer area on the transfer belt 13 synchronized with the superposed toner images on the photosensitive drum 1. At the transfer area, the transfer roller 12 imparts a bias voltage of a polarity opposite to that the toner. As a result, the toner images sequentially get transferred to the recording medium.

After transfer, the residual toner on the photosensitive drum 1 is cleaned by the cleaning device 14. The residual toner is first removed off the photosensitive drum 1 by the fur brush 16 followed by the action of the cleaning blade 15 disposed downstream to the fur brush 16, which thoroughly scrapes off any remaining toner. The toner thus collected is conveyed by a cleaning screw into a not shown waste toner bottle.

The recording sheet bearing thereon the color toner image and electrostatically adhered to the transfer belt 13 is carried up to the driving roller 10, where the leading edge of the recording sheet lifts off from the transfer belt 13 and is carried to the fixing device 18. In the fixing device 18, the recording sheet is transported clamped between the fixing belt 19 and the pressure roller while being subjected to heat application. After the toner image is fixed thus, the recording sheet is ejected to a stacking unit 26 via the ejection roller 27.

In duplex printing, the recording sheet is carried towards the reversing roller 28, which turns in the opposite direction and conveys the recording sheet to the registration roller 35 once again. The recording sheet is then conveyed to the nip portion of the transfer belt 13 in synchronization with the color toner image formed on the photosensitive drum 1, where the toner image is transferred to the backside of the recording sheet. The recording sheet is then conveyed through the fixing device 18 once again and ejected to the stacking unit 26.

Thus, in the image forming apparatus in which four developing devices are disposed around the photosensitive drum and are driven simultaneously, the vibrations caused by the developing devices are transmitted to the photosensitive drum 1, leading to variations in its rotational velocity. The effect of the vibrations on the rotational velocity of the photosensitive drum 1 can be dampened by providing a rotary inertial body in the form of a flywheel in the driving device, as explained below.

Figure 2:
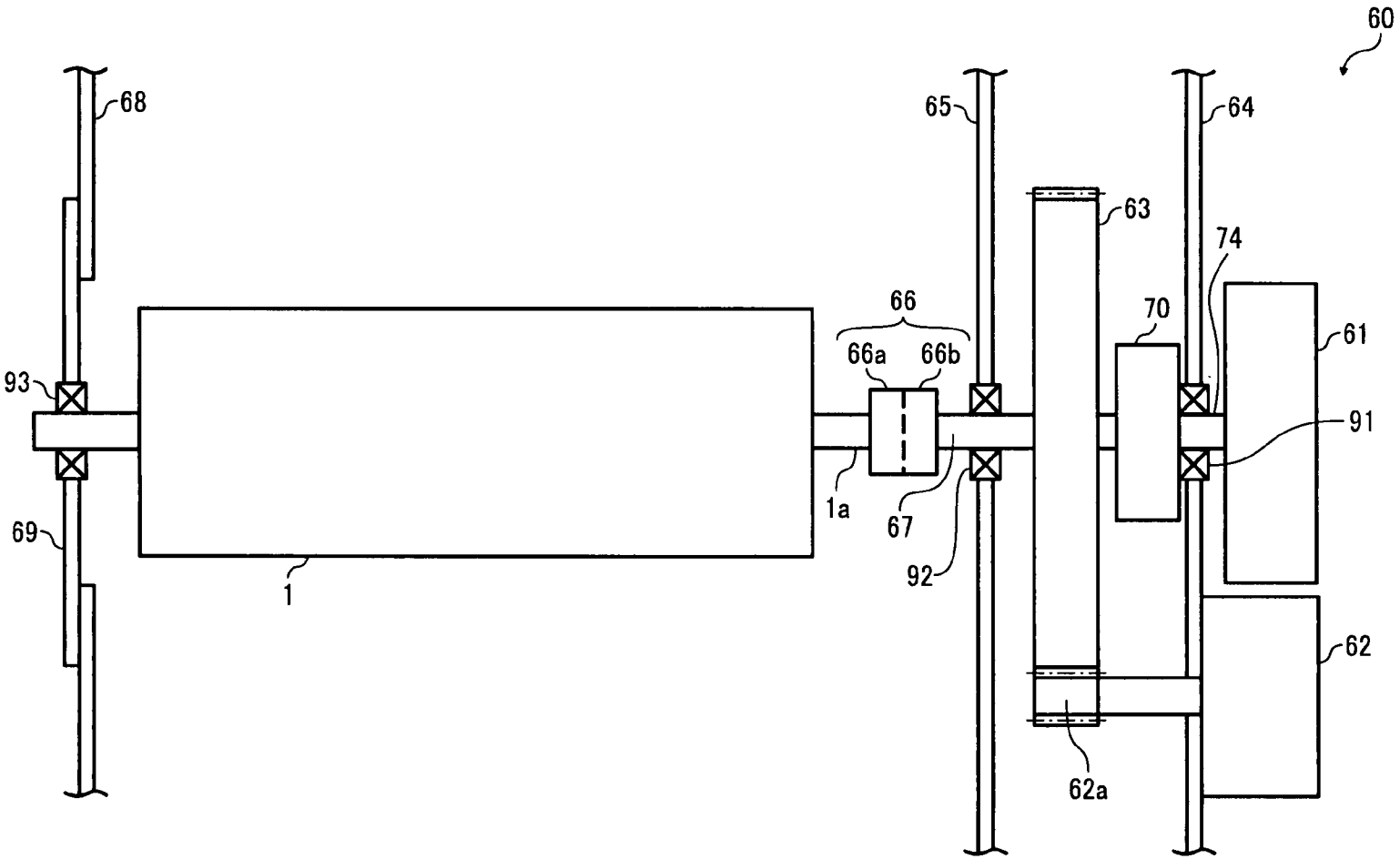
FIG. 2 is a schematic diagram of a driving device that rotates a photosensitive drum.

FIG. 2 is a schematic diagram of a driving device 60 that rotates the photosensitive drum 1.

The driving device 60 includes a driving-force source in the form of a driving motor 62, a rotary inertial body in the form of a flywheel 61 that prevents variations in the velocity at which the-photosensitive drum 1 rotates, a driving-force transmitting member in the form of a driving gear 63 that transmits the driving force of the driving motor 62 to the photosensitive drum 1 and the flywheel 61, a velocity-varying mechanism in the form of a satellite frictional gear mechanism 70 that steps up the rotational velocity of the flywheel 61 so that it rotates at a greater angular velocity than the photosensitive drum 1.

The driving motor 62 is fixed to a supporting plate 64. The driving gear 63 is engaged with an output gear 62*a* of the driving motor 62 and is fixed to an output shaft 67, which is coaxial with the rotary shaft 1*a* of the photosensitive drum 1. The pitch diameter of the driving gear 63 is greater than the diameter of the photosensitive drum 1. When the driving motor 62 rotates, its driving force is transmitted from the output gear 62*a* to the driving gear 63 such that the photosensitive drum 1 is driven at a stepped-down velocity. By enabling transmitting a stepped-down driving force to the photosensitive drum 1 without an additional gear, the number of components required in the driving device 60, and hence the cost, can be reduced. Further, ineffective driving force transmission arising from improper teeth meshing and eccentricity when two gears are provided can be avoided. To prevent banding (pitch irregularity of meshing cycle) in the toner image formed on the photosensitive drum 1 due to variation in the rotational velocity of the photosensitive drum and to obtain high-frequency area, it is preferable that the relational expression $m<(Dg/2\pi Dd)$ be satisfied, where m is the module (number of teeth/diameter of gear) of the driving gear 63, Dd is the diameter of the photosensitive drum 1, and Dg is the pitch diameter of the driving gear 63.

The satellite frictional gear mechanism 70 is attached to the aft-end of the output shaft 67. A driving-end coupling 66*b* is coaxially fixed to the drum-end of the output shaft 67. A sun shaft 74 of the satellite frictional gear mechanism extends coaxially with the rotary shaft 1*a* of the photosensitive drum 1. The sun shaft 74 serves as a sun frictional gear and is fixed to the flywheel 61. A shaft bearing 92 of an aft-end side plate 65 rotatably supports the output shaft 67. A shaft bearing 91 of the supporting plate 64 rotatably supports the sun shaft 74.

A shaft bearing 93 of a front plate 69 detachably attached to a fore-end plate 68 rotatably supports the fore-end of the rotary shaft 1*a* of the photosensitive drum 1. A driven-end coupling 66*a* is coaxially fixed to the aft-end of the rotary shaft 1*a* of the photosensitive drum.

The photosensitive drum 1, the front plate 69, the rotary shaft 1*a*, and the driven-end coupling 66*a* form an integrated unit that is detachably attached to the main unit of the image forming apparatus. When the photosensitive drum 1 is attached to the main unit, the driving-end coupling 66*b* and the driven-end coupling 66*a* are engaged in the rotation direction. When the output shaft 67 rotates, the rotation is transmitted to the rotary shaft 1*a* by the coupling mechanism 66 formed by the driven-end coupling 66*a* and the driving-end coupling 66*b*, thus driving the photosensitive drum 1.

Figure 3B:
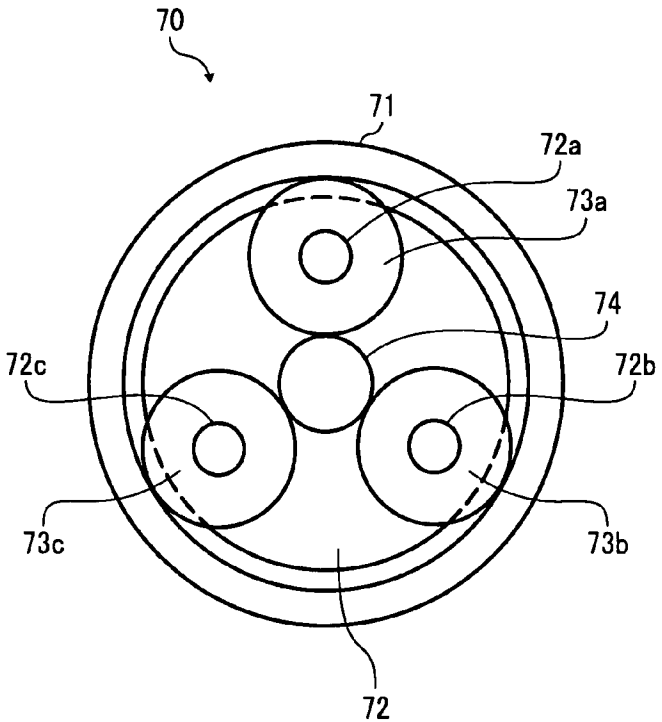
FIG. 3A is a side view and FIG. 3B is a front view of a cross-section of a satellite frictional gear mechanism.
Figure 3A:
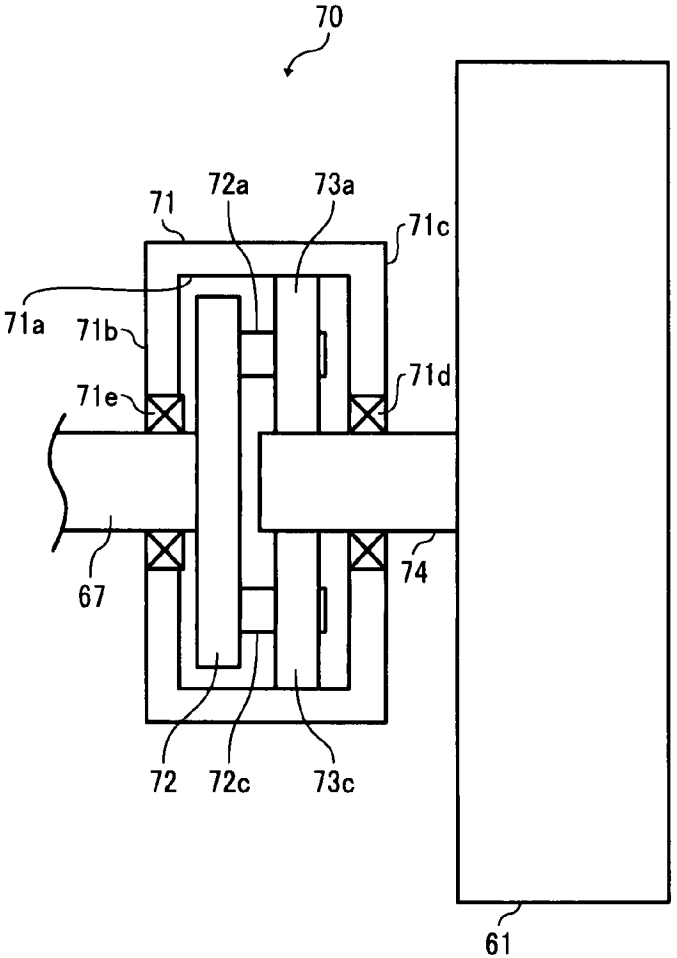

FIG. 3A is a side view of a cross-section of the satellite frictional gear mechanism 70 and FIG. 3B is a front view of the cross-section of the satellite frictional gear mechanism 70.

The satellite frictional gear mechanism 70 includes the sun shaft 74, three satellite frictional gears 73*a* to 73*c*, a carrier member 72, and an inscribed ring 71.

The carrier member 72 is coaxially fixed to the aft-end face of the output shaft 67. At the sun-shaft end of the carrier member 72, three satellite shafts 72*a* to 72*c* that are equidistant along the perimeter extend perpendicularly from the side face at three places. Each of the satellite frictional gears 73*a* to 73*b* is rotatably attached to its corresponding satellite shafts 72*a* to 72*c*. On the outer periphery of the satellite frictional gears 73*a* to 73*c*, the outer surface of the sun shaft 74 and the inner surface of the inscribed ring 71 are in pressure contact with each other. The sun shaft 74, the satellite frictional gears 73*a* to 73*c*, and the inscribed ring 71 are made of a highly rigid metal that can resist elastic deformation due to pressure contact. The inscribed ring 71 is tubular and includes circular faces 71*b* and 71*c* with holes at the centers thereon serving as shaft bearings 71*e* and 71*d*, respectively. The output shaft 67 passes through the shaft bearing 71*e* of the circular face 71*b*, and the sun shaft 74 passes through the shaft bearing 71*d* of the circular face 71*c*. Thus, the carrier member 72 within the inscribed ring 71 and the satellite frictional gears 73*a* to 73*c* are hermetically enclosed by the inscribed ring 71. Thus, no space is available between the satellite frictional gears 73 and the sun shaft 74 or between the satellite frictional gears 73 and the inner face of the inscribed ring 71 for a foreign substance such as scattered toner to adhere to. Therefore, the possibility of the satellite frictional gears 73 slipping due to the presence of toner, etc. is eliminated, and the driving force can be effectively transmitted to the flywheel 61. The inscribed ring 71 is fixed to the supporting plate 64.

Thus, the satellite frictional gear mechanism 70 includes an input unit that receives the rotational driving force in the form of the sun shaft 74, an output unit that steps up and outputs the angular velocity in the form of the carrier member 72, and a stationary member that remains stationary in the form of the inscribed ring 71. This structure enables the satellite frictional gear mechanism 70 to function as a velocity-varying mechanism. In the satellite frictional gear mechanism 70 shown in FIGS. 3A and 3B, the carrier member 72 functions as the input unit, the sun shaft 74 functions as the output unit, and the inscribed ring 71 functions as the stationary unit.

When the driving motor 62 rotates, the driving force is transmitted from the output gear 62*a* to the driving gear 63, causing the output shaft 67 to rotate. As a result, the driven-end coupling 66*a* engaged with the driving-end coupling 66*b* fixed to the output shaft 67 rotates, and the photosensitive drum 1 attached to the rotary shaft 1*a* rotates. In other words, the rotary-body driving-force transmitting mechanism that transmits the driving force of the driving motor to the photosensitive drum in the embodiment is the coupling mechanism 66.

As the photosensitive drum 1 rotates, the carrier member 72 of the satellite frictional gear mechanism 70 fixed to the aft-end face of the output shaft 67. The rotating carrier member 72 causes the satellite frictional gears 73*a* to 73*c* rotatably attached to the satellite shafts 72*a* to 72*c*, respectively, of the carrier member 72 to revolve around the sun shaft 74. As the satellite frictional gears 73*a* to 73*c* are in pressure contact with the inner surface of the inscribed ring 71 fixed to the supporting plate 64, the satellite frictional gears 73*a* to 73*c* rotate on their own axes while rolling over the contact surface with the inscribed ring 71. Further, as the satellite frictional gears 73*a* to 73*c* are in pressure contact with the sun shaft 74, the revolving motion as well as the rotation of the satellite frictional gears 73*a* to 73*c* on their own axes is transmitted to the sun shaft 74, causing it to rotate. In this way, the rotational velocity of the output shaft 67 is stepped by the satellite frictional gear mechanism 70 and output to the sun shaft 74, causing the flywheel 61 to rotate at a greater angular velocity than the photosensitive drum 1. Thus, in the embodiment, the satellite frictional gear mechanism 70 functions as the rotary-inertial-body driving-force transmitting mechanism that transmits the driving force of the driving motor to the flywheel serving as the rotary inertial body.

The rate of velocity increase brought about by the satellite frictional gear mechanism 70 can be calculated by the expression, Rate of velocity increase (Number of rotations of output shaft/number of rotations of input shaft)=($\pi$Di/$\pi$Ds)+1=(Di/Ds)+1, where Ds is the outer diameter of the sun shaft, Dp is the outer diameter of the satellite frictional gear, and Di is the inner diameter of the inscribed ring.

For example, if Ds=10, Dp=20, and Di=50, the rate of velocity increase will be six times.

As the rotational velocity of the output shaft 67 is stepped up by the satellite frictional gear mechanism 70 before being output to the sun shaft 74, the flywheel 61 attached to the sun shaft 74 can be made to rotate at a greater the angular velocity $\omega$ than the photosensitive drum 1.

By increasing the angular velocity $\omega$ of the flywheel 61, the inertial energy E, which is given by $(J\omega^2)/2$ (J is the inertial moment of the rotary inertial body and $\omega$ is the angular velocity of the rotary inertial body), can be increased. Thus, even if the flywheel 61 is light and of a small diameter, the inertial energy required for preventing variations in the velocity of the photosensitive drum 1 can be obtained. Thus, a space-saving driving device with a compact flywheel 61 can be realized without compromising on the effectiveness in controlling the velocity variation in the photosensitive drum 1.

In the embodiment, the flywheel 61 is placed alongside the driving motor 62, as shown in FIG. 2. In other words, the flywheel 61 is placed in such a way that the relational expression Rd>Rf+Rm is satisfied, where Rf is the radius of the flywheel, Rm is the radius of the driving motor, and Rd is the radius of the driving gear. Further, in the embodiment, the rate of velocity increase brought about by the satellite frictional gear mechanism 70 is determined such that the relational expression Rd>Rf+Rm is satisfied and in addition, there is no compromise on the control of velocity variation of the photosensitive drum 1 by the flywheel 61.

By satisfying the relational expression Rd>Rf+Rm, the length of the shaft (sun shaft 74) to which the flywheel 61 is attached can be kept short, thereby eliminating the possibility of bending of the sun shaft 74 due to the weight of the flywheel 61 and realizing a more compact driving device along the shaft direction.

Modifications of the driving device 60 are described next.

Figure 4:
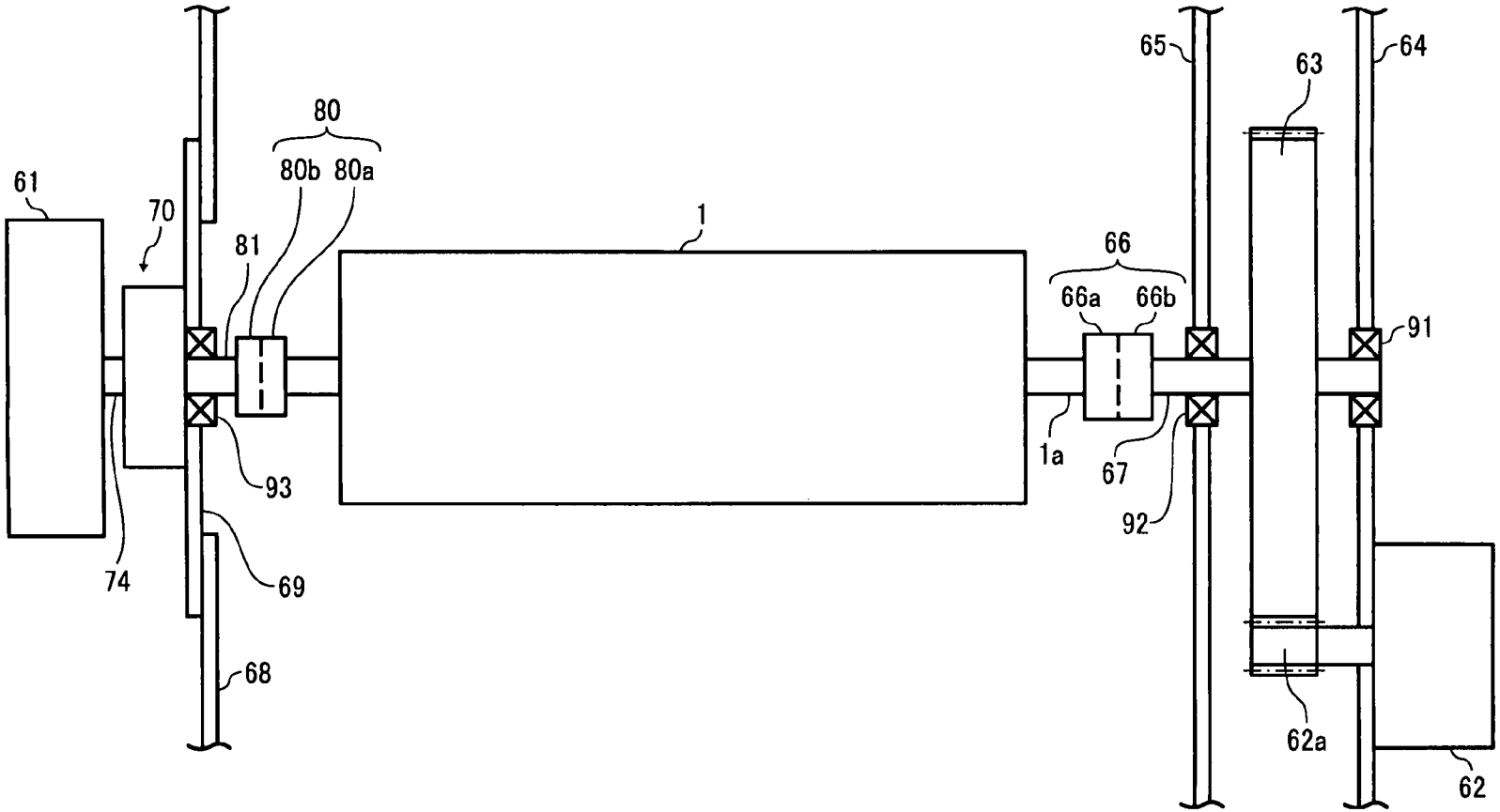
FIG. 4 is a drawing of the driving device according to a first modification.

FIG. 4 is a drawing of the driving device according to a first modification.

In a first modification of the driving device, the flywheel 61 and the satellite frictional gear mechanism 70 are set at the fore-end of the printer main unit. The inscribed ring 71 of the satellite frictional gear mechanism 70 is fixed to the front plate 69. A first coupling 80*a* is attached to the fore-end of the rotary shaft 1*a* and a second coupling 80*b* is attached to the aft-end of an input shaft 81. The first coupling 80*a* and the second coupling 80*b* are engaged in the rotation direction. The input shaft 81 is rotatably supported by the front plate, and the carrier member 72 is fixed to the fore-end of the input shaft 81.

In the first modification, the driving force of the driving motor 62 is transmitted from the output gear 62*a* to the driving gear 63, causing the output shaft 67 to rotate. The rotating output shaft 67 causes the rotary shaft 1*a* and thus the photosensitive drum 1 to rotate via the coupling mechanism 66. The rotation of the rotary shaft 1*a* is transmitted to the input shaft 81 via the coupling mechanism 80 formed by the first coupling 80*a* and the second coupling 80*b*. The velocity is stepped up by the satellite frictional gear mechanism 70 and output to the sun shaft 74, causing the flywheel 61 attached to the sun shaft 74 to rotate at a greater angular velocity than the photosensitive drum 1. In other words, in the first modification, the rotary-inertial-body driving-force transmitting mechanism that transmits the driving force of the motor to the flywheel includes the coupling mechanism 80, the input shaft 81, and the satellite frictional gear mechanism 70.

In the driving device according to the first modification, by placing the flywheel in the fore-end of the device main unit, the space in the aft-end of the device can be more efficiently utilized. Further, the satellite frictional gear mechanism 70 and the flywheel 61 can be detached at the coupling mechanism 80 for replacing the photosensitive drum 1.

Figure 5:
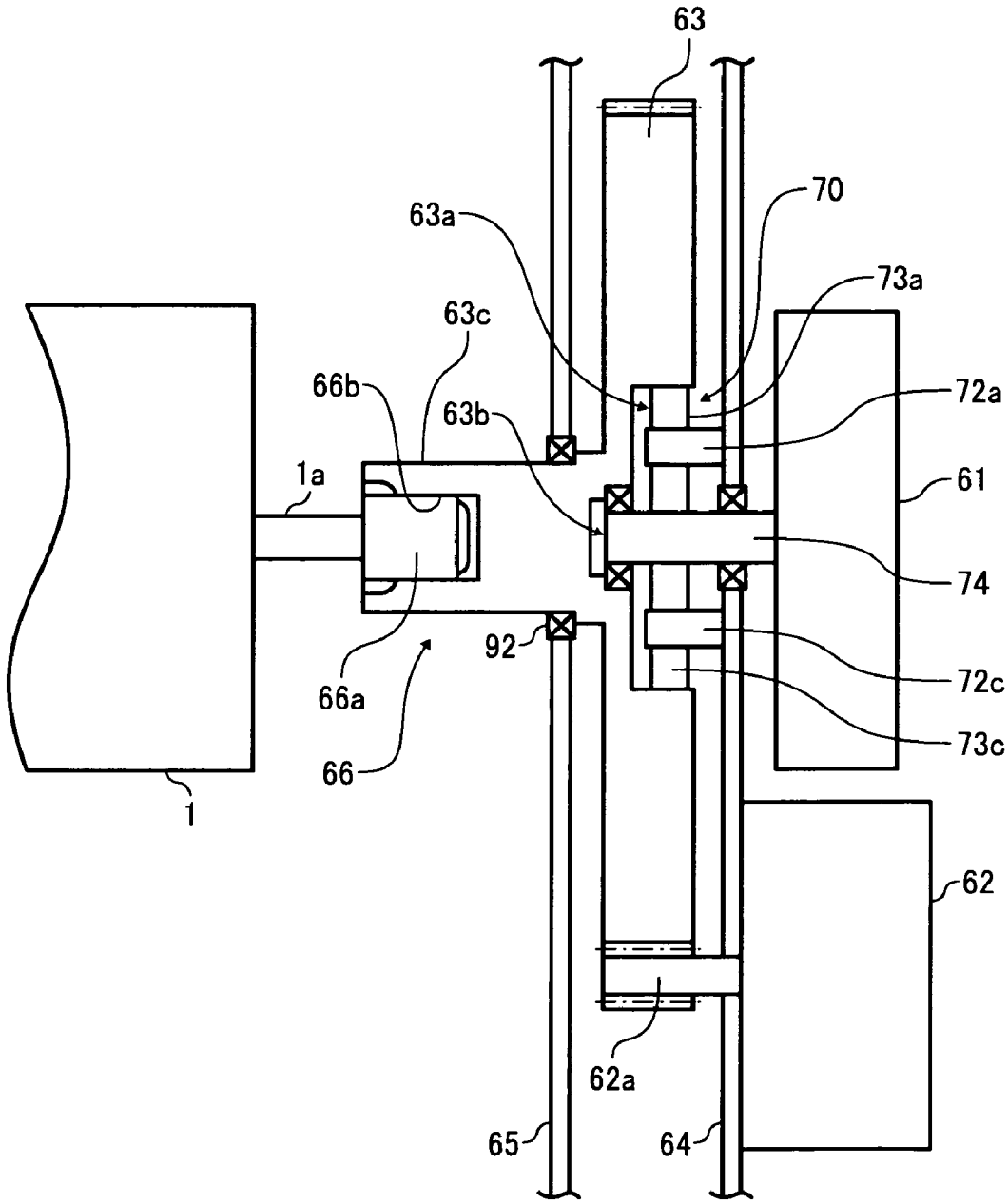
FIG. 5 is a drawing of the driving device according to a second modification.

FIG. 5 is a drawing of the driving device according to a second modification.

In the driving device according to the second modification, a circular depressed portion 63*a* is provided around the rotational center of the driving gear 63. A second depressed portion 63*b* is provided around the rotational center of the depressed portion 63*a*. The fore-end of the sun shaft 74 is rotatably attached to the second depressed portion 63*b* by a shaft bearing. The sun shaft 74 is rotatably supported by another shaft bearing in the supporting plate. The flywheel 61 is fixed to the aft-end of the sun shaft 74. Three satellite shafts 72*a* to 72*c* (the satellite shaft 72*b* is not seen in FIG. 5) that are equidistant along the rotation direction of the sun shaft 74 and are coaxial with the shaft center of the sun shaft 74 extend perpendicularly from the supporting plate 64. Each of the satellite frictional gears 73*a* to 73*c* is rotatably attached to its corresponding satellite shaft 72*a* to 72*c* (the satellite frictional gear 73*b* is not seen in FIG. 5). The satellite frictional gears 73*a* to 73*c* are in pressure contact with the outer surface of the sun shaft 74 and the inner surface of the depressed portion 63*a* of the driving gear 63.

In other words, in the driving device according to the second modification, the satellite frictional gear mechanism includes the depressed portion 63*a* of the driving gear 63, the sun shaft 74, the satellite frictional gears 73*a* to 73*c*, and the satellite shafts 72*a* to 72*c*.

In the driving device according to the second modification, an output unit 63*c* is provided coaxially with the rotational center of the driving gear 63 on its fore-end face (on the side of the photosensitive drum 1). A female coupling 66*b* in the form of a cylindrical depressed portion is provided at the leading end of the output unit 63*c*. The cylindrical depressed portion of the female coupling 66*b* has an annular gear having a plurality of gears on the inner periphery. A male coupling 66*a* is provided on the rotary shaft 1*a* of the photosensitive drum 1, including a gear that engages with the annular gear of the female coupling 66*b*. Alternatively, the male coupling 66*a* may be provided on the output unit 63*c* and the female coupling 66*b* may be provided on the rotary shaft 1*a*. The driving gear 63 is rotatably supported by a shaft bearing provided on the aft-end side plate 65.

When the driving motor 62 rotates, the velocity transmitted by the output gear 62*a* is reduced by the driving gear 63, and the reduced velocity is transmitted to the photosensitive drum 1 via the coupling mechanism 66. The rotation of the driving gear 63 causes the satellite frictional gears 73*a* to 73*c* in pressure contact with the depressed portion 63*a* of the driving gear 63 to rotate on their own axes. As the satellite frictional gears 73*a* to 73*c* are in pressure contact with the sun shaft 74, the rotation of the satellite frictional gears 73*a* to 73*c* on their own axes is transmitted to the sun shaft 74. Thus, the rotational velocity of the driving gear 63 is increased by the satellite frictional gear mechanism 70, and the increased rotational velocity is output to the sun shaft 74, which in turn causes the flywheel 61 to rotate at increased velocity. In other words, in the satellite frictional gear mechanism 70 of the driving device according to the second modification, the depressed portion 63*a* of the driving gear 63 functions as the input unit, the satellite shafts 72*a* to 72*c* function as the stationary units, and the sun shaft 74 functions as the output unit. The rate of velocity increase brought about by the satellite frictional gear mechanism 70 according to the second modification is determined by the following expression. Rate of velocity increase=$\pi Di/\pi Ds=-Di/Ds$, where Di is the diameter of the depressed portion 63*a* of the driving gear 63 and Ds is the outer diameter of the sun shaft 74. The minus symbol indicates that the rotations of the input shaft and the output shaft are in the opposite directions. For example, if the diameter Di of the depressed portion 63*a* of the driving gear 63 is 50, the diameter Dp of the satellite frictional gear is 20, and the diameter of the sun shaft 74 is 10, the rate of velocity increase will be five times.

Thus, in the driving device according to the second modification too, causing the flywheel 61 to rotate at a greater angular velocity $\omega$ than the photosensitive drum 1 enables the radius Rf of the flywheel 61 to be kept small and, in addition, the relational expression Rd (radius of the driving gear 63)>Rf (radius of the flywheel 61)+Rm (radius of the driving motor 62) can be satisfied without compromising on the control of velocity variation of the photosensitive drum 1 by the flywheel 61. Thus, as shown in FIG. 5, the driving motor 62 and the flywheel 61 can be placed side by side in the radial direction of the rotary shaft 1*a*, realizing a more compact driving device along the shaft direction.

The depressed portion 63*a* of the driving gear 63 of the driving device according to the second modification functions as the inscribed ring. Thus, the number of components, and hence the cost, can be reduced. Further, by accommodating a part of the satellite frictional gear mechanism inside the driving gear, the length of the driving device in the shaft direction can be reduced, achieving space-saving.

It is preferable to make the driving gear 63 out of resin to dampen the vibrations in the gear mechanism serving as the transmitting mechanism between the output gear 62*a* and the driving gear 63. However, in the case of a resin driving gear 63, the inner surface of the depressed portion 63*a* can undergo elastic deformation due to pressure contact with the satellite frictional gears 73*a* to 73*c*, leading to inadequate pressure contact between the satellite frictional gears 73*a* to 73*c* and the inner surface of the depressed portion 63*a*, and resulting in slipping between the satellite frictional gears 73*a* to 73*c* and the inner surface of the depressed portion 63*a*, and ineffective transmission of the driving force to the sun shaft 74.

Figure 6:
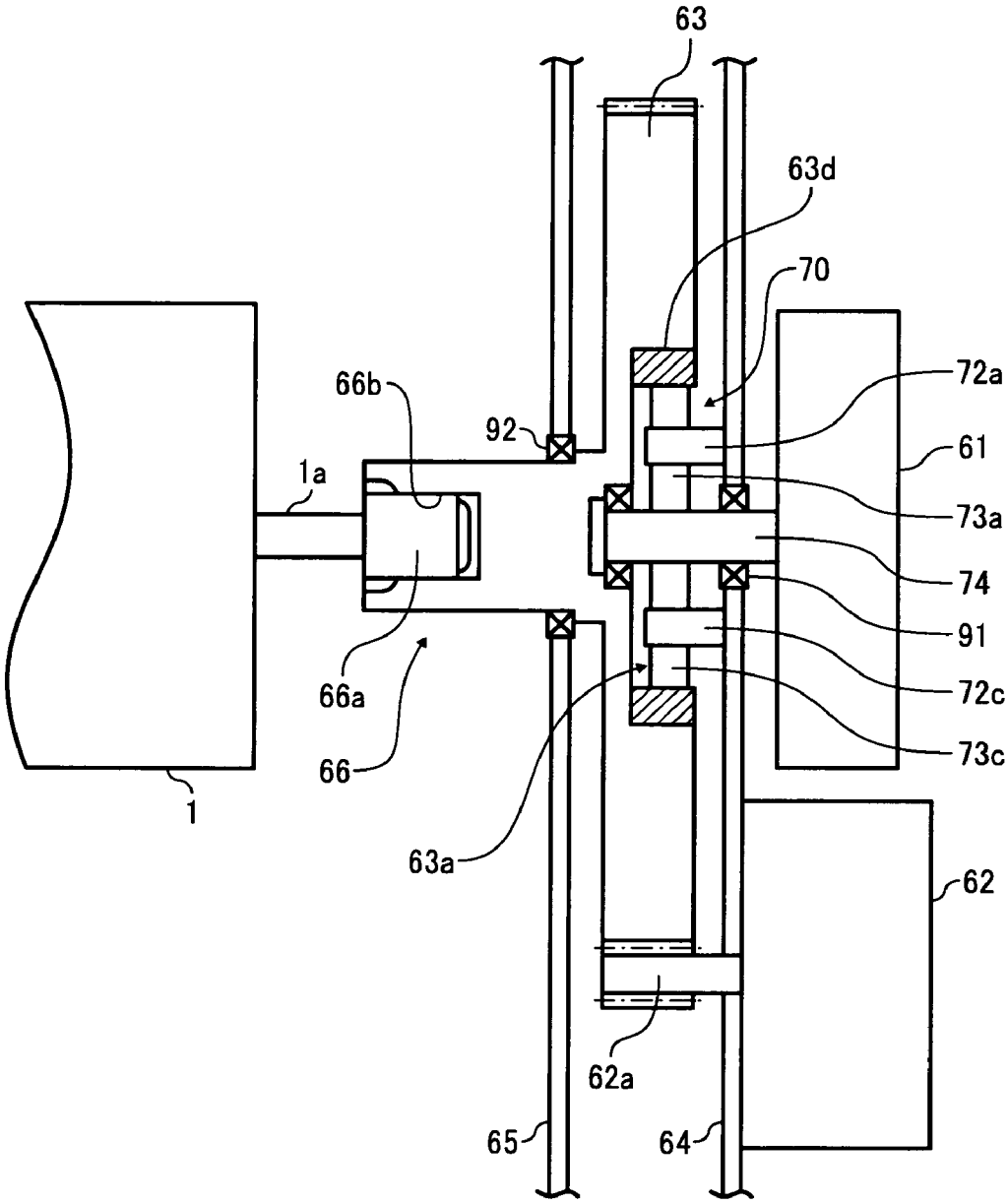
FIG. 6 is a drawing of the driving device according to the second modification in which a metal ring is set in a depressed portion of a driving gear.

Therefore, in the case of a resin driving gear 63, a metal ring 63*d* is fitted into the inner surface of the depressed portion 63*a*, as shown in FIG. 6. Alternatively, the metal ring 63*d* is inserted when injection-molding the driving gear 63. By providing the metal ring 63*d* on the inner surface of the depressed portion 63*a*, elastic deformation of the inner surface due to pressure contact with the satellite frictional gears can be prevented, thus enabling a smooth driving force transmission to the sun shaft 74. A resin driving gear 63 is advantageous in that it can dampen the vibrations occurring in the gear mechanism serving as a transmitting mechanism between the output gear 62*a* and the driving gear 63, thus preventing velocity variations of the photosensitive drum 1.

Figure 7:
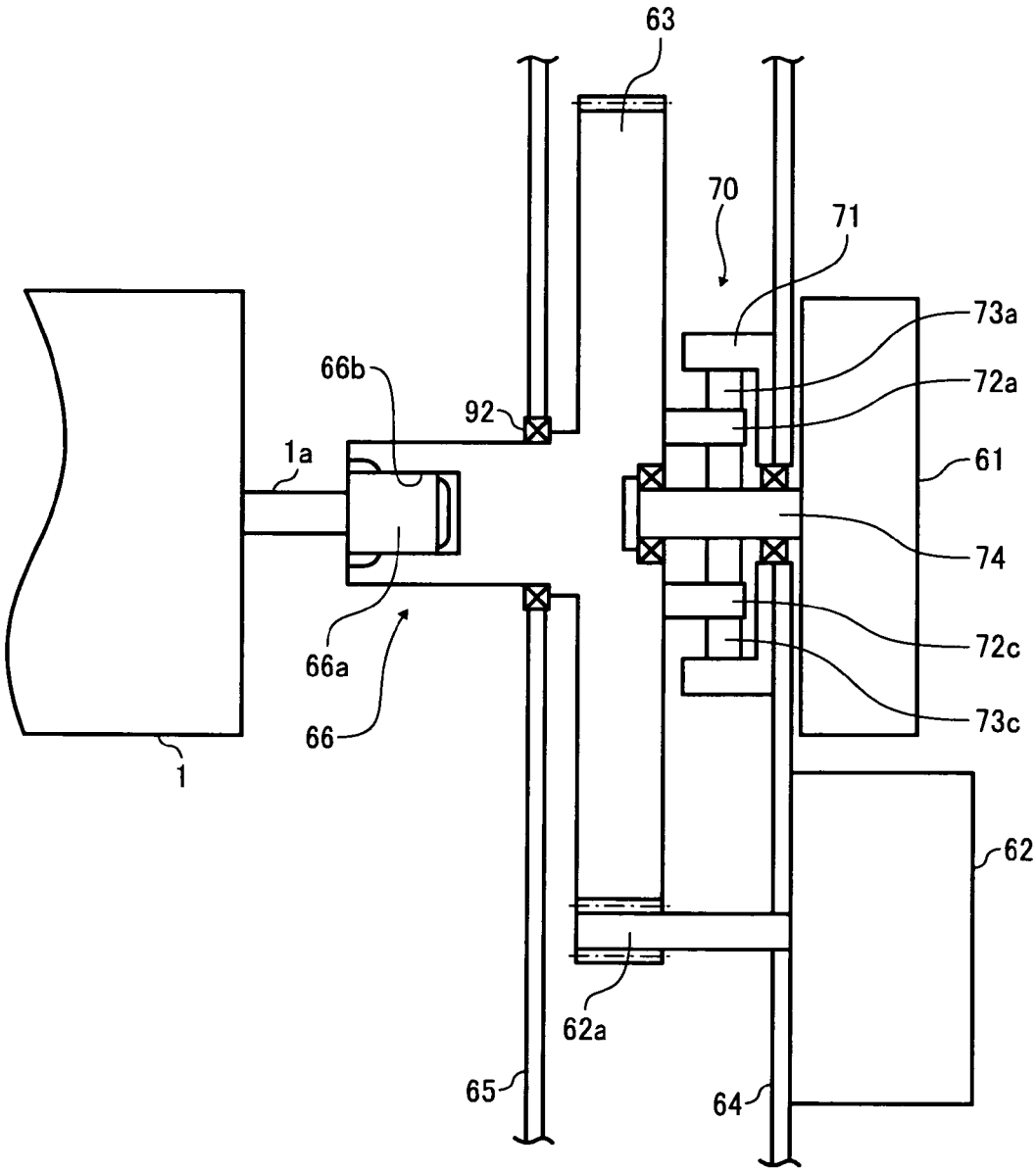
FIG. 7 is a drawing of the driving device according to a third modification.

FIG. 7 is a drawing of the driving device according to a third modification.

In the third modification of the driving device, the satellite shafts 72*a* to 72*c* (the satellite shaft 72*b* is not seen in FIG. 7) that are equidistant along the rotation direction of the driving gear 63 and are coaxial with the shaft center of the sun shaft 74 extend perpendicularly from the aft-end face of the driving gear 63. The sun shaft 74 is rotatably supported at two points, namely, a fixed shaft bearing provided at the rotational center of the driving gear 63 and the shaft bearing provided on the supporting plate 64. The flywheel 61 is fixed to the aft-end of the sun shaft 74. The inscribed ring 71 is fixed to the supporting plate 64.

In other words, the satellite frictional gear mechanism 70 in the driving device according to the third modification includes the sun shaft 74, the satellite frictional gears 73*a* to 73*c*, the satellite shafts 72*a* to 62*c* set in the driving gear 63, and the inscribed ring 71.

When the driving motor 62 rotates, the velocity transmitted by the output gear 62*a* is reduced by the driving gear 63, and the reduced velocity is transmitted to the photosensitive drum 1 via the coupling mechanism 66. The rotation of the driving gear 63 causes the satellite shafts 72*a* to 72*c* to rotate around the sun shaft 74. As a result, the satellite frictional gears 73*a* to 73*c* rotatably attached to the satellite shafts 72*a* to 72*c*, respectively, start revolving around the shaft center of the sun shaft 74. As the satellite frictional gears 73*a* to 73*c* are in pressure contact with the inner surface of the inscribed ring 71 fixed to the supporting plate 64, the satellite frictional gears 73*a* to 73*c* rotate on their own axes while rolling over the contact surface with the inscribed ring 71. The rotation of the satellite frictional gears 73*a* to 73*c* on their own axes is transmitted to the sun shaft 74. Thus, the rotational velocity of the driving gear 63 is increased by the satellite frictional gear mechanism 70, and the increased rotational velocity is output to the sun shaft 74, which in turn causes the flywheel 61 to rotate at increased velocity. In other words, in the satellite frictional gear mechanism 70 of the driving device according to the second modification, the depressed portion 63*a* of the driving gear 63 functions as the input unit, the satellite shafts, 72*a* to 72*c* function as the stationary units, and the sun shaft 74 functions as the output unit. The rate of velocity increase brought about by the satellite frictional gear mechanism 70 according to the second modification is determined by the following expression. Rate of velocity increase=$\pi Di/\pi Ds=-Di/Ds$, where Di is the diameter of the depressed portion 63*a* of the driving gear 63 and Ds is the outer diameter of the sun shaft 74. The minus symbol indicates that the rotations of the input shaft and the output shaft are in the opposite directions. For example, if the diameter Di of the depressed portion 63*a* of the driving gear 63 is 50, the diameter Dp of the satellite frictional gear is 20, and the diameter of the sun shaft 74 is 10, the rate of velocity increase will be five times. As the satellite frictional gears 73*a* to 73*c* are in pressure contact with the inner surface of the inscribed ring 71 fixed to the supporting plate 64, the satellite frictional gears 73*a* to 73*c* rotate on their own axes. Further, as the satellite frictional gears 73*a* to 73*c* are in pressure contact with the sun shaft 74, the revolving motion as well as the rotation of the satellite frictional gears

73*a* to 73*c* around their own axes is transmitted to the sun shaft 74, causing it to rotate. In this way, the rotational velocity of the driving gear 63 is stepped by the satellite frictional gear mechanism 70 and output to the sun shaft 74, causing the flywheel 61 to rotate at increased velocity. In other words, in the satellite frictional gear mechanism 70 of the driving device according to the third modification, the satellite shafts 72*a* to 72*c* function as the input units, the inscribed ring 71 functions as the stationary unit, and the sun shaft functions as the output unit.

The rate of velocity increase brought about by the satellite frictional gear mechanism according to the third modification is similar to that shown in FIG. 2. In other words, Rate of velocity increase=($\pi$Di/$\pi$Ds)+1=(Di/Ds)+1. For example, if Ds=10, Dp=20, and Di=50, the rate of velocity increase will be six times.

Thus, in the driving device according to the third modification too, causing the flywheel 61 to rotate at a greater angular velocity $\omega$ than the photosensitive drum 1 enables the radius Rf of the flywheel 61 to be kept small and, in addition, the relational expression Rd (radius of the driving gear 63)>Rf (radius of the flywheel 61)+Rm (radius of the driving motor 62) can be satisfied without compromising on the control of velocity variation of the photosensitive drum 1 by the flywheel 61. Thus, as shown in FIG. 7, the driving motor 62 and the flywheel 61 can be placed side by side in the radial direction of the rotary shaft 1*a*, realizing a more compact driving device along the shaft direction.

As the carrier member 72 is done away with in the third modification, the number of components, and hence the cost, can be reduced.

Figure 8:
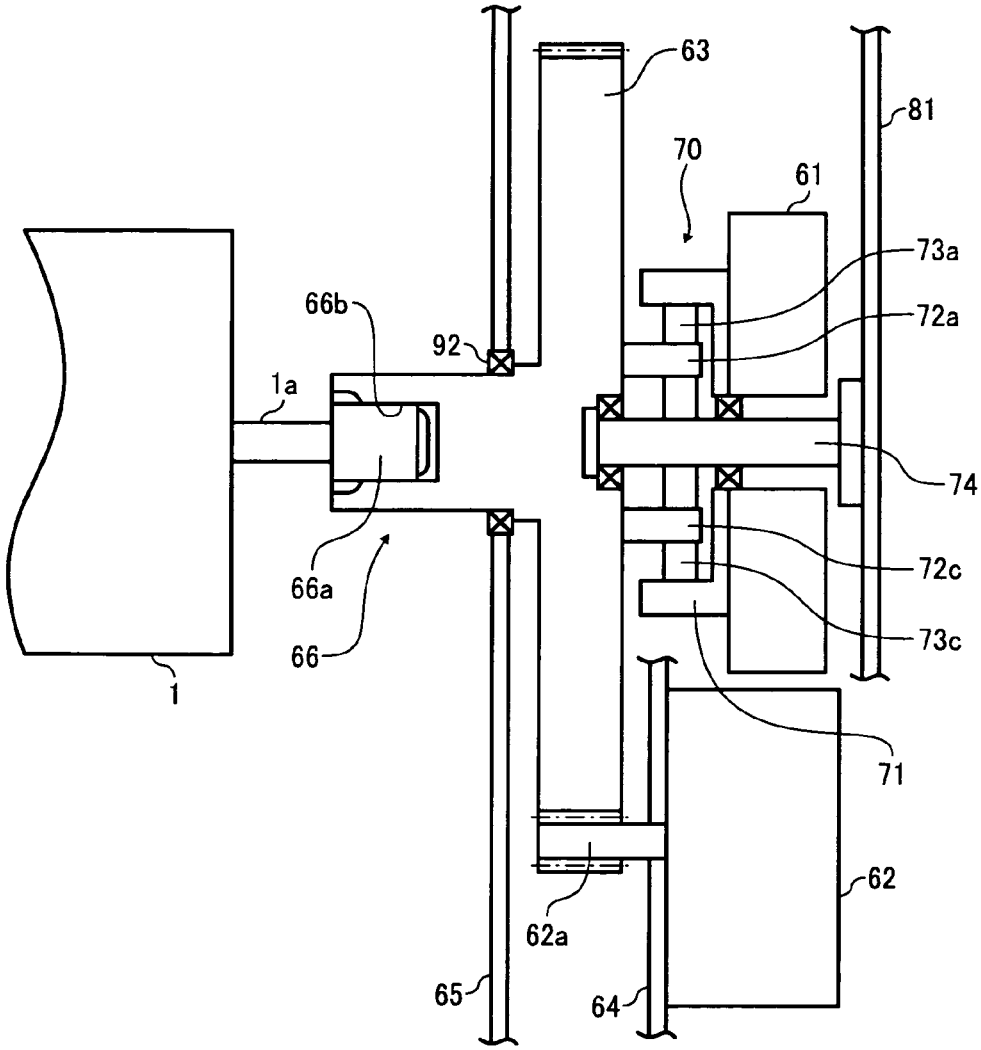
FIG. 8 is a drawing of the driving device according to a fourth modification.

FIG. 8 is a drawing of the driving device according to a fourth modification.

In the driving device according to the fourth modification, similar to the third modification, the satellite shafts 72*a* to 72*c* (the satellite shaft 72*b* is not seen in FIG. 7) that are equidistant along the rotation direction of the driving gear 63 and are coaxial with the shaft center of the sun shaft 74 extend perpendicularly from the aft-end face of the driving gear 63. A bracket 81 is fixed to the aft-end of the sun shaft 74. The fore-end of the sun shaft is rotatably supported by a shaft bearing at the rotational center of the driving gear. The flywheel 61 is fixed to the inscribed ring 71, both the inscribed ring 71 and the flywheel 61 being rotatably supported by the axle bearing fixed to the sun shaft 74. The satellite frictional gear mechanism 70 of the driving device according to the fourth modification includes, similar to the third modification, the sun shaft 74, the satellite frictional gears 73*a* to 73*c*, the satellite shafts 72*a* to 72*c* set in the driving gear 63, and the inscribed ring 71.

When the driving motor 62 rotates, the velocity transmitted by the output gear 62*a* is reduced by the driving gear 63, and the reduced velocity is transmitted to the photosensitive drum 1 via the coupling mechanism 66. The rotation of the driving gear 63 causes the satellite shafts 72*a* to 72*c* to rotate around the sun shaft 74. As a result, the satellite frictional gears 73*a* to 73*c* rotatably attached to the satellite shafts 72*a* to 72*c*, respectively, start revolving around the shaft center of the sun shaft 74. As the satellite frictional gears 73*a* to 73*c* are in pressure contact with the outer surface of the sun shaft 74 fixed to the bracket 81, the satellite frictional gears 73*a* to 73*c* rotate on their own axes while rolling over the contact surface of the sun shaft 74. Further, as the satellite frictional gears 73*a* to 73*c* are in pressure contact with the inscribed ring 71, the revolving motion as well as the rotation of the satellite frictional gears 73*a* to 73*c* around their own axes is transmitted to the inscribed ring 71, causing it to rotate. Thus, the rotational velocity of the driving gear 63 is increased by the satellite frictional gear mechanism 70, and the increased rotational velocity is output to the inscribed ring, which in turn causes the flywheel 61 to rotate at increased velocity. In other words, in the satellite frictional gear mechanism 70 of the driving device according to the fourth modification, the satellite frictional gears 73*a* to 73*c* set in the driving gear 63 function as the input units, the sun shaft 74 functions as the stationary unit, and the inscribed ring 71 functions as the output unit.

The rate of velocity increase brought about by the satellite frictional gear mechanism 70 according to the fourth modification is determined by the following expression. Rate of velocity increase=($\pi$Ds/$\pi$Di)+1=Ds/Di+1. For example, if the Ds=10, Dp=20, and Di=50, the rate of velocity increase will be 1.2 times.

Thus, in the driving device according to the fourth modification too, causing the flywheel 61 to rotate at a greater angular velocity $\omega$ than the photosensitive drum 1 enables the radius Rf of the flywheel 61 to be kept small and, in addition, the relational expression Rd (radius of the driving gear 63)>Rf (radius of the flywheel 61)+Rm (radius of the driving motor 62) can be satisfied without compromising on the control of velocity variation of the photosensitive drum 1 by the flywheel 61. Thus, as shown in FIG. 8, the driving motor 62 and the flywheel 61 can be placed side by side in the radial direction of the rotary shaft 1*a*, realizing a more compact driving device along the shaft direction.

As the carrier member 72 is done away with in the fourth modification, the number of components, and hence the cost, can be reduced.

Figure 9:
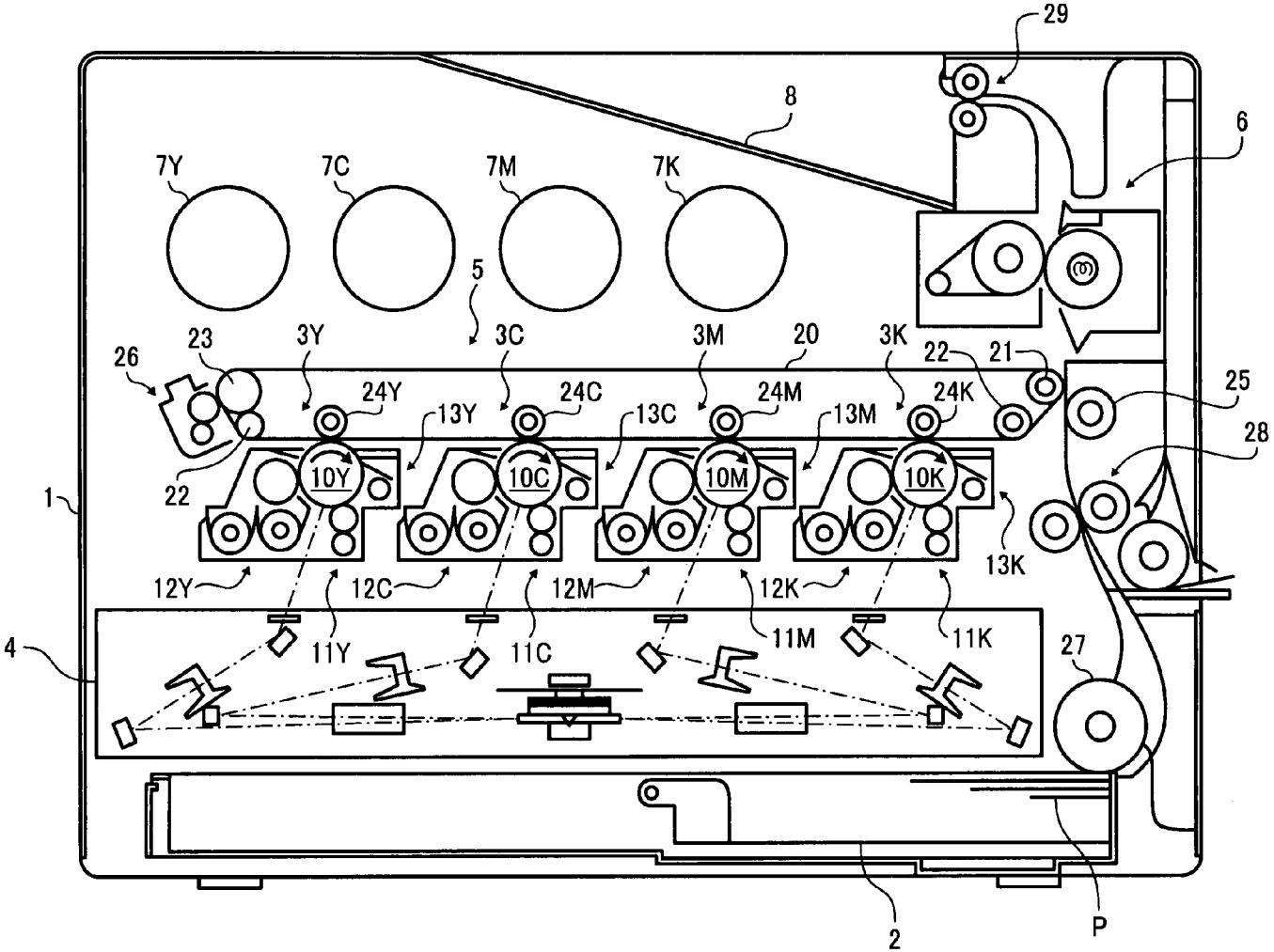
FIG. 9 is a drawing of a tandem-type color image forming apparatus.
Figure 10:
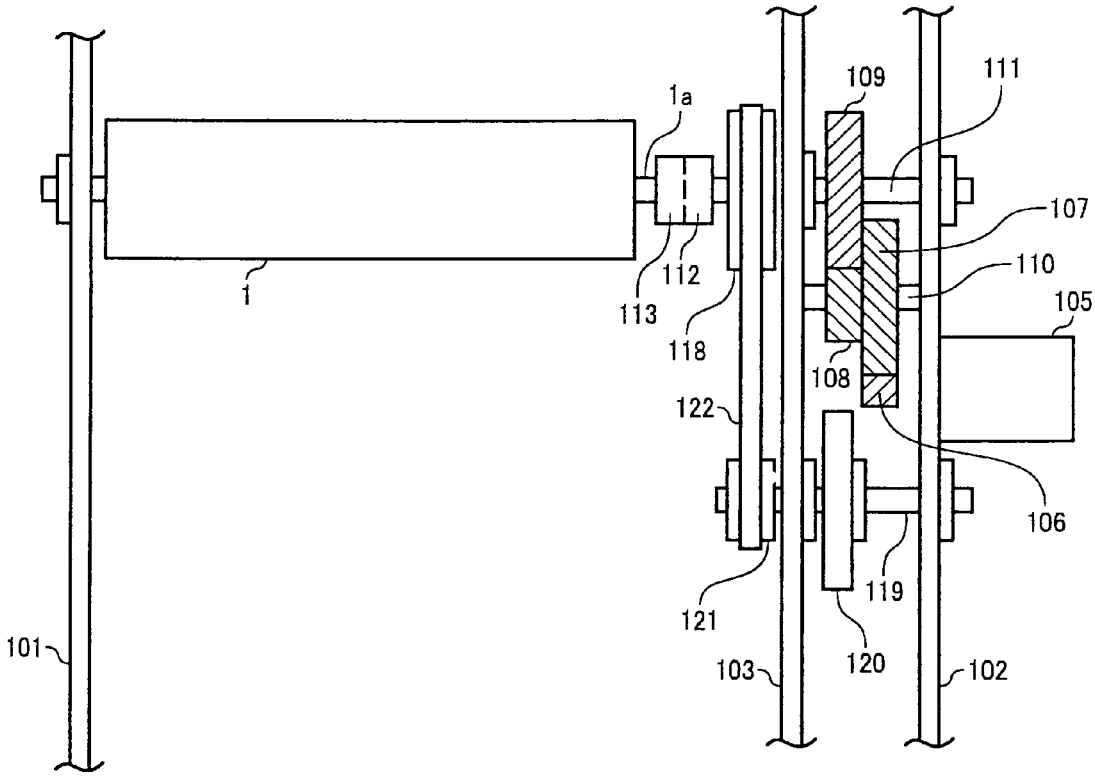
FIG. 10 is a drawing of a conventional driving device.
Figure 11:
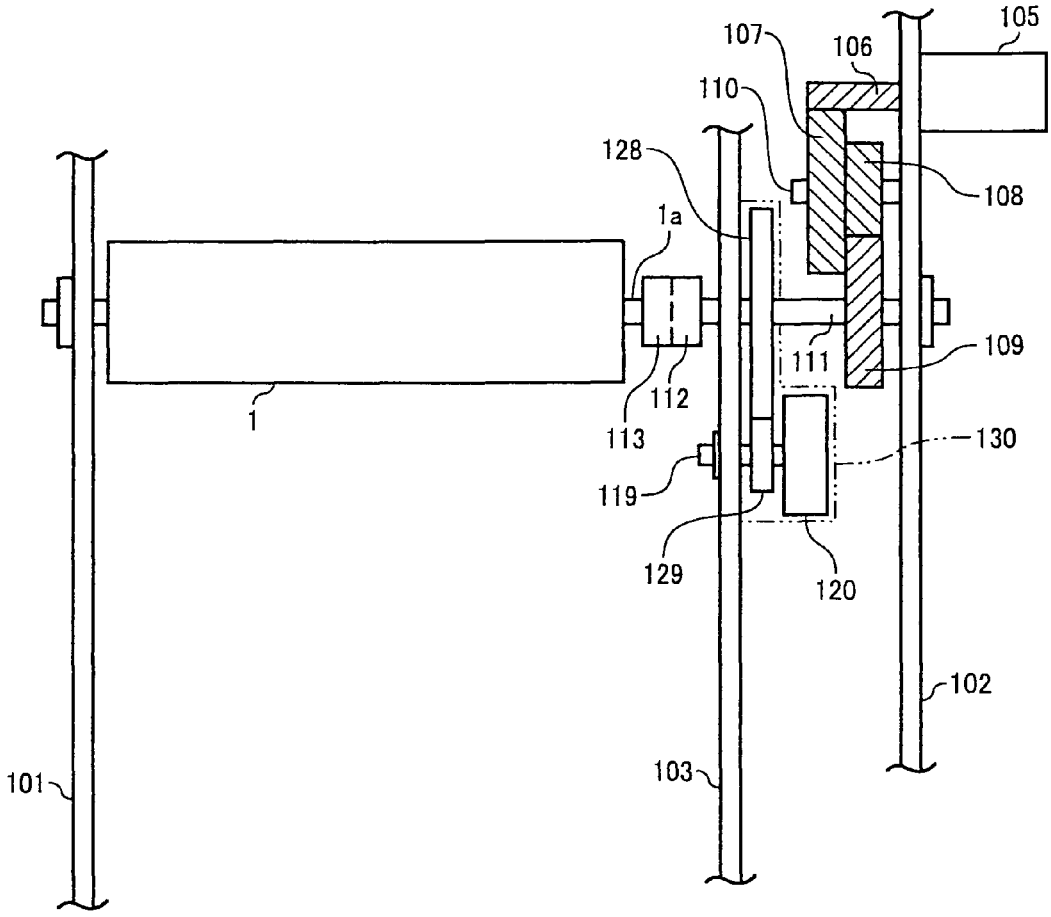
FIG. 11 is a drawing of another conventional driving device.

Apart from the image forming apparatus shown in FIG. 1, the driving device according to the embodiment can be adapted to a tandem-type color image forming apparatus shown in FIG. 9. The number of satellite frictional gears need not be limited to three and can be any appropriate number. The driving device according to the embodiment can also be adapted to a driving device that drives the developing roller or the fixing belt 19 or the transfer belt 13.

In the embodiment, the satellite frictional gear mechanism increases the rotational velocity transmitted to the flywheel, causing the flywheel to rotate at a greater angular velocity than the photosensitive drum. Alternatively, the satellite frictional gear mechanism can be used to decrease the rotational velocity transmitted to the photosensitive drum to attain the same effect. In this case too, the inertial energy J can be increased with reduced flywheel size, compared with when the flywheel and the photosensitive drum are rotating at the same velocity. Yet another method to cause the flywheel to rotate at a greater angular velocity than the photosensitive drum is to provide in the rotary-body driving-force transmitting mechanism a satellite frictional mechanism that reduces the rotational velocity, and provide in the rotary-inertial-body driving-force transmitting mechanism a satellite frictional mechanism that increases the rotational velocity. Yet another alternative to cause the flywheel to rotate at a greater angular velocity than the photosensitive drum is to provide in both the rotary-body driving-force transmitting mechanism and the rotary-inertial-body driving-force transmitting mechanism a satellite frictional mechanism each for reducing the rotational velocity but setting the rate of velocity decrease of the satellite frictional mechanism of the rotary-body driving-force transmitting mechanism higher than that of the rotary-inertial-body driving-force transmitting mechanism. Yet another alternative is to provide in both the rotary-body driving-force transmitting mechanism and the rotary-inertial-body driving-force transmitting mechanism a satellite frictional mechanism each for increasing the rotational velocity but setting the rate of velocity increase of the satellite frictional mechanism of the rotary-inertial-body driving-force transmitting mechanism greater than that of the rotary-body driving-force transmitting.

Thus, the driving device according to the embodiment includes a satellite frictional gear mechanism that causes the flywheel 61 to rotate at a greater angular velocity than the photosensitive drum 1. Hence, even with a light and small-diameter flywheel, the inertial energy required for preventing velocity variations of the photosensitive drum can be attained. Thus, a space-saving driving device with a compact flywheel can be realized without compromising on the effectiveness in controlling the velocity variation in the photosensitive drum 1.

Further, as the frictional force of the satellite frictional gear mechanism 70 is transmitted as the driving force, there are no undesirable effects such as bending of the rotary shaft 1*a* or meshing vibrations. As a result, the vibrations of the photosensitive drum due to the angular velocity increase transmitting mechanism can be prevented. Further, by using the satellite frictional gear mechanism, the input shaft and the output shaft are coaxially arranged, the flywheel 61 can be set coaxial with the rotary shaft, realizing a more compact driving device along the shaft direction.

In the driving device according to the embodiment, placing the driving-force transmitting member that inputs the driving force of the driving motor between the photosensitive drum 1 and the satellite frictional gear mechanism enables the flywheel to be set coaxially with the rotary shaft at the driving motor end.

As shown in FIG. 3, the inscribed ring 71 of the satellite frictional gear mechanism 70 completely surrounds and hermetically encloses the satellite frictional gears 73. Consequently, scattering foreign substances such as scattered toner cannot get in the space between the inscribed ring 71 and the satellite frictional gears 73 or between the sun shaft 74 that serves as the sun frictional gear and the satellite frictional gears 73. Consequently, the possibility of the satellite frictional gears 73 slipping due to the presence of toner, etc. is eliminated, and the driving force can be effectively transmitted to the flywheel 61.

In the second modification of the driving device, the satellite frictional gears 73 are in pressure contact with the inner surface of the depressed portion provided around the rotational center of the driving gear at one end and with the outer surface of the sun shaft at the other end. Consequently, as compared to the structure of the driving device shown in FIG. 2, by doing away with the inscribed ring 71, cost reduction can be achieved. Also, by accommodating a part of the satellite frictional gear mechanism inside the driving gear, as compared to the structure of the driving device shown in FIG. 2, the length of the driving device in the shaft direction can be reduced, achieving space-saving.

By using a resin driving gear 63, the vibrations in the gear transmission unit between the output gear 62*a* and the driving gear 63 can be dampened, and velocity variations of the photosensitive drum 1 can be prevented. By using a metal member in the inner surface of the depressed portion, elastic deformation of the inner surface of the depressed portion when the satellite frictional gears come in pressure contact with it. Thus, the pressure contact between the satellite frictional gears 73 and the inner surface of the depressed portion can be maintained and slipping of the satellite frictional gears 73 can be prevented, and the driving force can be effectively transmitted to the flywheel.

In the third modification of the driving device, the satellite frictional gears are disposed equidistant along perimeter of a circle that is coaxial with the driving gear. Thus, by doing away with the carrier member, the cost of the driving device can be reduced.

Further, the driving force is transmitted by engagement of the driving gear and the output gear of the driving motor. Therefore, even if the rotational load of the photosensitive drum becomes significant, the driving force of the driving motor can be effectively transmitted by the driving gear.

By placing the driving motor and the flywheel alongside each other along the radial direction of the rotary shaft, a more compact driving device along the shaft direction can be realized.

By providing the driving-force transmitting member, the rotary inertial body, and the satellite frictional transmitting mechanism on the side of the image forming apparatus main unit, the number of parts that need to be replaced along with the photosensitive drum can be reduced.

By adapting the driving device according to the embodiment to the image forming apparatus, velocity variations in the rotary body can be prevented. By using the driving device according to the embodiment particularly as the driving device for rotating the image carrying member, faulty images with bands can be prevented.

In the image forming apparatus in which four developing devices are arranged around the photosensitive drum and are driven at the same time, the vibrations produced by the four developing devices can cause rotational velocity variations in the photosensitive drum. However, the photosensitive drum can be made to rotate at a constant velocity by using the driving device according to the embodiment to drive the photosensitive drum, thus preventing faulty images with bands.

As described above, according to an aspect of the present invention, a velocity-varying mechanism is provided that causes a rotary inertial body to rotate at a greater angular velocity than a rotary body. Thus, even with a light, small-radius rotary inertial body the inertial energy required for preventing velocity variations in the rotary body can be obtained. Thus, a space-saving driving device with a compact rotary inertial body and greater flexibility in terms of layout can be realized without compromising on the effectiveness in controlling the velocity variation in the rotary body.

Further, a satellite frictional gear mechanism is used as the velocity-varying mechanism to transmit frictional force as the driving force. Consequently, there are no meshing vibrations which are produced by gear mechanism in which there teeth meshing of the gears takes place. The satellite frictional gear mechanism includes a plurality of satellite frictional gears arranged equidistant along the perimeter of a sun frictional gear and in pressure contact with the sun frictional gear and an inner surface of a inscribed ring. Therefore, in spite of being a method whereby the driving force is generated by the frictional force, there is no bending of an input shaft or an output shaft caused by the velocity-varying mechanism, as described in the conventional technologies. As a result, the vibrations of the rotary body caused by the velocity-varying mechanism can be prevented. Further, by using the satellite frictional gear mechanism, the input shaft and the output shaft can be made coaxial, and hence the rotary inertial body can be provided coaxial with the rotary shaft. By providing the rotary inertial body coaxial with the rotary shaft, a more compact driving device along the radial direction of the rotary shaft can be obtained, as compared to the driving devices disclosed in the conventional technologies.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A driving device for driving a rotary body, comprising:

a driving-force source that outputs a rotational driving force;

a rotary-body driving-force transmitting mechanism that transmits the driving force of the driving-force source to the rotary body;

a rotary inertial body for dampening a velocity fluctuation in rotation velocity of the rotary body; and a rotary-inertial-body driving-force transmitting mechanism that transmits the driving force of the driving-force source to the rotary inertial body; wherein the rotary-body driving-force transmitting mechanism includes a down-shift unit that shifts down the driving force of the driving-force source and transmits a down-shifted driving force to the rotary body, the rotary-inertial-body driving-force transmitting mechanism includes an up-shift unit that shifts up the down-shifted driving force and transmits an up-shifted driving force to the rotary inertial body, the rotary inertial body, the down-shift unit, and the up-shift unit are arranged coaxially with a rotation axis of the rotary body, the up-shift unit includes a sun axis arranged coaxially with the rotation axis of the rotary body and is coupled to the rotary body, a carrier that includes a plurality of satellite shafts arranged equidistant along a circumferential direction of a circle that is coaxial with the sun axis, a plurality of satellite wheels respectively arranged on the satellite shafts, each of the satellite wheels rotating around its corresponding satellite shaft, and an inscribed ring in which the satellite wheels are inscribed, the satellite wheels being in pressure contact with the sun axis and the inscribed ring, and the rotation axis of the rotary body coupled to the inscribed ring, so that the down-shifted driving force is transmitted to the inscribed ring, which drives in turn the satellite wheels and the sun axis, shifting up the down-shifted driving force, thus transmitting the up-shifted driving force to the rotary inertial body.

2. The driving device according to claim 1, wherein the down-shift unit, the up-shift unit, and the rotary inertial body are arranged in turn on one side of the rotary body.

3. The driving device according to claim 1, wherein the down-shift unit is arranged on one side of the rotary body, and the up-shift unit and the rotary inertial body are arranged on an other side of the rotary body.

4. The driving device according to claim 1, wherein the down-shift unit is a driving gear engaged with an output gear of the driving-force source.

5. The driving device according to claim 4, wherein the driving gear is a single down-shift gear that shifts down the driving force of the driving-force source, and an outer diameter of the rotary inertial body is smaller than an outer diameter of the driving gear so that the driving-force source and the rotary inertial body are arranged in parallel to each other with respect to the rotation axis of the rotary body.

6. The driving device according to claim 1, wherein the inscribed ring hermetically encloses at least the satellite wheels.

7. An electrophotographic image forming apparatus comprising:

an image carrier configured to form an image thereon; and a driving device according to claim 1, wherein the rotary body is the image carrier.

8. The image forming apparatus according to claim 7, further comprising a plurality of developing devices provided around the image carrier, the developing devices containing different colors toners, respectively, wherein with a single rotation of the image carrier, a full color image is formed on the image carrier.

9. A driving device for driving a rotary body, comprising:

a driving-force source that outputs a rotational driving force;

a rotary-body driving-force transmitting mechanism that transmits the driving force of the driving-force source to the rotary body;

a rotary inertial body for dampening a velocity fluctuation in rotation velocity of the rotary body; and a rotary-inertial-body driving-force transmitting mechanism that transmits the driving force of the driving-force source to the rotary inertial body; wherein the rotary-body driving-force transmitting mechanism includes a down-shift unit that shifts down the driving force of the driving-force source and transmits a down-shifted driving force to the rotary body, the rotary-inertial-body driving-force transmitting mechanism includes an up-shift unit that shifts up the down-shifted driving force and transmits and up-shifted driving force to the rotary inertial body, the rotary inertial body, the down-shift unit, and the up-shift unit are arranged coaxially with a rotation axis of the rotary body, the down-shift unit includes a depressed portion of a circular shape around a rotation axis of the down-shift unit, the up-shift unit includes a sun axis arranged coaxially with the rotation axis of the rotary body and coupled to the rotary inertial body, a carrier that includes a plurality of satellite shafts arranged equidistant along a circumferential direction of a circle that is coaxial with the sun axis, and a plurality of satellite wheels respectively arranged on the satellite shafts, each of the satellite wheels rotating around its corresponding satellite shaft, the satellite wheels being in pressure contact with the sun axis and an inner surface of the depressed portion, and a rotation force of the down-shift unit is transmitted to the satellite wheels via the depressed portion, which drives in turn the satellite wheels and the sun axis, shifting up the down-shifted driving force, thus transmitting the up-shifted driving force to the rotary inertial body.

10. The driving device according to claim 9, wherein the down-shift unit is made of resin, and the inner surface of the depressed portion is made of metal.

11. The driving device according to claim 9, wherein the down-shift unit is a driving gear engaged with an output gear of the driving-force source.

12. The driving device according to claim 11, wherein the driving gear is a single down-shift gear that shifts down the driving force of the driving-force source, and an outer diameter of the rotary inertial body is smaller than an outer diameter of the driving gear so that the driving-force source and the rotary inertial body are arranged in parallel to each other with respect to the rotation axis of the rotary body.

13. An electrophotographic image forming apparatus comprising:

an image carrier configured to form an image thereon; and a driving device according to claim 9, wherein the rotary body is the image carrier.

14. The image forming apparatus according to claim 13, further comprising a plurality of developing devices provided around the image carrier, the developing devices containing different color toners, respectively, wherein with a single rotation of the image carrier, a full color image is formed on the image carrier.

15. A driving device for driving a rotary body, comprising:

a driving-force source that outputs a rotational driving force;

a rotary-body driving-force transmitting mechanism that transmits the driving force of the driving-force source to the rotary body;

a rotary inertial body for dampening a velocity fluctuation in rotation velocity of the rotary body; and a rotary-inertial-body driving-force transmitting mechanism that transmit the driving force of the driving-force source to the rotary inertial body; wherein the rotary-body driving-force transmitting mechanism includes a down-shift unit that shifts down the driving force of the driving-force source and transmits a down-shifted driving force to the rotary body, the rotary-inertial-body driving-force transmitting mechanism includes an up-shift unit that shifts up the down-shifted driving force and transmits an up-shifted driving force to the rotary inertial body, the rotary inertial body, the down-shift unit, and the up-shift unit are arranged coaxially with a rotation axis of the rotary body, the down-shift unit includes a plurality of satellite shafts arranged equidistant along a circumferential direction of a circle that is coaxial with the down-shift unit, the up-shift unit includes a sun axis arranged coaxially with the rotation axis of the rotary body and coupled to the rotary inertial body, a plurality of satellite wheels respectively arranged on the satellite shafts, each of the satellite wheels rotating around its corresponding satellite shaft and revolving around the sun axis, and an inscribed ring in which the satellite wheels are inscribed, the satellite wheels being in pressure contact with the sun axis and the inscribed ring, and a rotation force of the down-shift unit is transmitted to the satellite wheels via the satellite shafts, which drives in turn the satellite wheels and the sun axis, shifting up the down-shifted driving force, thus transmitting the up-shifted driving force to the rotary inertial body.

16. The driving device according to claim 15, wherein the down-shift unit is a driving gear engaged with an output gear of the driving-force source.

17. The driving device according to claim 16, wherein the driving gear is a single down-shift gear that shifts down the driving force of the driving-force source, and an outer diameter of the rotary inertial body is smaller than an outer diameter of the driving gear so that the driving-force source and the rotary inertial body are arranged in parallel to each other with respect to the rotation axis of the rotary body.

18. An electrophotographic image forming apparatus comprising:

an image carrier configured to form an image thereon; and a driving device according to claim 15, wherein the rotary body is the image carrier.

19. The image forming apparatus according to claim 18, further comprising a plurality of developing devices provided around the image carrier, the developing devices containing different color toners, respectively, wherein with a single rotation of the image carrier, a full color image is formed on the image carrier.

* * * * *